United States Patent [19]

Dailly et al.

[11] Patent Number: 4,481,075

[45] Date of Patent: Nov. 6, 1984

[54] SHEET PRODUCTS AND PREPARATION PROCESS THEREOF

[75] Inventors: Christian Dailly, Neuilly Plaisance; Daniel Gomez, Mimizan, both of France

[73] Assignee: Arjomari-Prioux, Paris, France

[21] Appl. No.: 459,380

[22] Filed: Jan. 10, 1983

Related U.S. Application Data

[63] Continuation of Ser. No. 253,512, Mar. 10, 1981, abandoned.

[63] Continuation of Ser. No. 253,512, filed as PCT FR 80/00115, Jul. 8, 1980, published as WO 81/00268, Feb. 5, 1981 § 102(e) date Mar. 10, 1981, abandoned.

[30] Foreign Application Priority Data

Jul. 10, 1979 [FR] France ..... 79 17910

[51] Int. Cl.[3] ..... D21H 5/18

[52] U.S. Cl. ..... 162/145; 162/146; 162/164.1; 162/168.1; 162/169; 162/175; 162/181.1; 162/183; 428/281; 428/288

[58] Field of Search ..... 162/145, 181.1, 183, 162/168.1, 168.2, 135, 175, 164.1, 169, 146, 164; 428/281, 288

[56] References Cited

U.S. PATENT DOCUMENTS

| | | | |
|---|---|---|---|
| 2,601,597 | 6/1952 | Daniel | 162/164.3 |
| 2,955,067 | 10/1960 | McBurney | 162/168.1 |
| 3,184,373 | 5/1965 | Arledter | 162/168.1 |
| 4,002,527 | 1/1977 | Piersol | 162/169 |
| 4,269,657 | 5/1981 | Gomez | 162/135 |
| 4,274,916 | 6/1981 | Grose | 162/183 |

FOREIGN PATENT DOCUMENTS

| | | |
|---|---|---|
| 1338038 | 10/1962 | France . |
| 1338039 | 10/1962 | France . |
| 1496935 | 10/1966 | France . |
| 896117 | 5/1962 | United Kingdom . |
| 1118221 | 6/1968 | United Kingdom . |
| 1263812 | 2/1972 | United Kingdom . |
| 1319371 | 6/1973 | United Kingdom . |

*Primary Examiner*—Peter Chin

*Attorney, Agent, or Firm*—Weingarten, Schurgin, Gagnebin & Hayes

[57] ABSTRACT

New process, for preparing by means of a paper manufacturing technique, a thermoplastic sheet reinforced with cellulose fibres, wherein a thermoplastic powder and cellulose fibres are used in association, if necessary with other fibres, and consisting in (1) preparing an aqueous suspension from a base mixture (selected among (i) the fibres and the pulverulent thermoplastic substance when there is no non-binding mineral charge, and (ii) the fibres, the pulverulent thermoplastic substance and the non-binding mineral char harge when the latter is present), an organic binder and a flocculating agent, and with the resulting suspension, forming a sheet by wet process, which is then wrung and dried and (2) if necessary subjecting the resulting thermoplastic sheet to at least a complementary treatment, the weight ratio of pulverulent thermoplastic substance to fibres being between 0.3 and 95. Thermoplastic reinforced sheets as a novel industrial product and application thereof particularly in the firld of transformation of plastic materials.

8 Claims, No Drawings

SHEET PRODUCTS AND PREPARATION PROCESS THEREOF

This is a continuation of application Ser. No. 253,512, filed Mar. 10, 1981 now abandoned.

The present invention relates to novel products in sheet form containing a thermoplastic and cellulosic fibres; it also relates to a process for preparing said novel products and to the applications of said novel products.

It has already been recommended to improve certain properties of the thermoplastics substances by incorporating therein fibres with high modulus of elasticity. Glass, carbon, asbestos and boron fibres are currently used for reinforcing certain thermoplastics substances, such as polyamides, polycarbonates, polyalkylenes (polyethylenes and polypropylenes), polyesters, polystyrenes, with a view to increasing the rigidity, resistance to shock, tensile strength, and to improving the dimensional stability.

Furthermore, it is known that cellulosic fibres have already been used for reinforcing thermosetting substances, such as urea-formaldehyde and melamine-formaldehyde resins, which have a good chemical affinity for cellulose, which circumstance promotes the dispersion of the cellulosic fibres within the polymer (cf. to this end British Pat. No. 1 319 371 which describes the preparation of a sheet from cellulosic fibres and an organic filler in powder form constituted by an urea-formaldehyde polymer).

Finally, French Pat. No. 70 31148 recommends in particular a process for manufacturing a paper sheet based on cellulose fibres, which may contain substantial quantities of a finely divided natural or synthetic polymer.

Thus, the known materials based on fibres and plastics material are in two different classes: one consisting in reinforcing a thermoplastic material with relatively small quantities of a reinforcing fibre, the other consisting in modifying the properties of a paper based on cellulosic fibres by the incorporation, in this paper, of a certain quantity of a thermoplastic material.

The present invention covers the technical domain consisting in the reinforcement of a thermoplastics material using cellulosic fibres.

Thus, the present invention desribes a novel technical solution for solving the problem of the dispersion of cellulosic fibres within a thermoplastic polymer, which consists in operating in a medium where said cellulosic fibres are easily dispersible; a sheet is formed by paper-making methods from an aqueous suspension comprising the cellulosic fibres and the thermoplastics substance in powder form, on the one hand, and other essential ingredients (binding agent and flocculating agent as indicated hereinafter), on the other hand.

One of the purposes of the invention is to propose a thermoplastics sheets having improved mechanical properties and more precisely important properties such as rigidity, tensile strength, resistance to shock and dimensional stability.

Another purpose of the invention is to obtain, by means of a paper machine, a thermoplastics sheet which, after having been shaped and dried, may be subjected to a complementary treatment (such as impregnation, couching, glazing) conventional in paper-making.

A further object of the invention is to improve the dimensional stability, the internal cohesion in the dry and wet state, suppleness and resistance to bending of a thermoplastic sheet substrate which may be used in particular as coating support for covering panels and, in particular, for ground coverings.

It is another object of the invention to propose a novel material to industries transforming plastics material in the form of granules obtained by cutting up and granulation of the thermoplastics sheet manufactured on paper machine according to the process.

The following advantages of the invention may in particular be mentioned:

savings of thermoplastics material resulting from the use of materials with reinforced properties, savings in production costs resulting from the use of machines with a high hourly rate of production (paper machines), replacing machines for manufacturing the thermoplastics sheets by calendering, extrusion or coating.

The following applications of the invention may in particular be mentioned:

use of the thermoplastics sheets manufactured on paper machine as support for coating of plasticized PVC for ground covering when the thermoplastics substance introduced into the sheet is PVC and the sheet is filled and plasticized;

the use of the thermoplastics sheet manufactured on paper machine as calendering material;

the use of the thermoplastics sheet manufactured on paper machine as heat-shaping material;

the use of the thermoplastics sheet as support of coating or couching for printing-writing;

the transformation of the thermoplastics sheet manufactured on paper machine by cutting up and possibly granulation, into a raw material for use in extrusion, blow-moulding, injection, moulding.

The materials in sheet form according to the present invention are characterised in that they comprise:

the constituents of a basic mixture comprising 5 to 30% by weight of cellulosic fibres 95 to 70% by weight of a powder of thermoplastics material and the elements indispensable for preparing a shapable sheet by application of the paper-making techniques, namely, essentially at least one organic binding agent and at least one flocculating agent.

According to the invention, any cellulosic fibre or mixtures of these fibres may be used. However, the preferred cellulosic fibres are those which are refined to a Shopper-Riegler (S.R.) degree of between 15 and 65. Fibres of softwood will advantageously be chosen as they are more resistant than those of hardwood.

It is possible to replace part of the cellulosic fibres which constitute the basic mixture by mineral or organic, natural or synthetic fibres. Thus, in the materials according to the invention, about 30% of the fibres may be non-cellulosic.

Table I hereinafter gives a list of cellulosic or non-cellulosic fibres which may be used within the scope of the invention.

Among non-cellulosic fibres, particular mention will be made of the possible use of glass fibres which are especially advantageous as they give the products in sheet form according to the invention a dimensional stability which is quite remarkable. When it is desired to use large quantities of these glass fibres, it has appeared desirable to use, simultaneously, polyvinyl alchol fibres, insoluble in cold water, whose function is to facilitate the dispersion of the glass fibres in the aqueous suspensions.

Particularly advantageous mixtures of fibres are constituted by about 14 parts of cellulosic fibres, 2 parts of glass fibres and possibly 1 part of polyvinyl alcohol fibres.

All thermoplastics substances in powder form (also called thermoplastics polymers here) are suitable for making the thermoplastics sheet according to the invention and, in particular, polyvinyl chloride (PVC), polyvinyl acetate (PVA), polyalkylenes—particularly high density polyethylene (hdPE, low density polyethylene (ldPE), polypropylene (hdPP; ldPP), polybutadiene and polyisoprene, polystyrene (PS), polyamides (PA), the polymers and copolymers obtained in particular from acrylonitrile, acrylic and methacrylic acids and esters thereof, polycarbonate (PC), polyacetal and thermoplastics polyesters. Among suitable copolymers, mention may particularly be made of acrylonitrile-styrene, methyl methacrylate-butadiene-styrene, styrene-butadiene, ABS copolymers. If need be, the thermoplastics substance may be previously associated with a plasticizer. The preferred substance is possibly plasticized PVC.

The thermoplastics powders may advantageously be used straight from polymerisation when their granulometry is appropriate. Failing this, they must be ground to obtain the desired granulometry. Recovered plastics materials are also suitable on condition that they are correctly ground. Thermoplastics powders are preferably chosen whose granulometry is less than or equal to 500 microns.

Moreover, part of the powder of thermoplastics material used in the basic mixture may be replaced by a non-binding mineral filler. A list of non-binding mineral fillers is given, by way of example, in Table IV. These fillers, used currently in the paper-making industry, have particles whose dimensions (mean diameter) are at the most equal to 80 microns. The quantity of non-binding filler will at the most be 40% by weight with respect to the weight of the thermoplastics material in powder form.

The materials according to the invention will comprise at least one organic binding agent indispensable for constituting the sheets in accordance with the paper-making technique. The binding agent ensures the bonding of the constituents of the thermoplastics sheet and may, if need be, reinforce the physical properties of the sheet. Among the suitable binding agents, particular mention may be made of those of Table II hereinafter. The preferred binding agents are latexes (acrylics, styrene-butadiene) and starch, particularly starch comprising in its linear polymer constituent (i.e. amylose) 50 to 6000 anhydroglucose units per molecule, such as for example native starch (obtained from potato) and native starch of maize which contains 100 to 6000 anhydroglucose units (in the linear polymer) per molecule, and starches modified by chemical or enzymatic means which contain 50 to 3000 anhydroglucose units (in the linear polymer) per molecule.

The quantity of binding agent which may be used is from 0.2 to about 30 parts by dry weight (advantageously 2 to 10 parts by dry weight) for 100 parts of the basic mixture (fibres and thermoplastics powder—possibly mineral filler).

The materials according to the invention will also comprise at least one flocculating agent indispensable for constituting the sheet in accordance with the paper-making technique.

Among suitable flocculating agents, particular mention may be made of metal salts, such as in particular salts of aluminium, iron(II), iron(III), zinc and chromium, such as halides, sulfates and phosphates and the other substances indicated in Table III hereinafter. The preferred flocculating agent according to the invention is aluminium polychloride which is a substance also known under the name of aluminium hydroxychloride, whose general formula is $(OH)_yAl_xCl_{z-y-x}$ and which is particularly marketed by the firm Pechiney Ugine Kuhlmann under the trademark "WAC".

The or each flocculating agent will, according to the process of the invention, be used in two fractions: The first fraction of the flocculating agent, which is introduced before the binding agent, and the binding agent ensure a first agglomeration of the constituents of the basic mixture. The second fraction of the flocculating agent reinforces the cohesion of the constituents of the basic mixture and thus improves the retention on the paper machine and the resistance of the flocs. Of course, either the same flocculating agent may be used before and after the binding agent, or different flocculating agents, or, finally, mixtures of flocculating agents.

The quantity of flocculating agent which may be used is, in total, 0.02 to about 10 parts for 100 parts of the basic mixture.

Other adjuvants, conventional in paper-making, such as water-repellant agents, lubricating agents, anti-foaming or foam-breaking agents, dyes, optical blueing agents, antioxidants, may be present in the sheets according to the invention.

Table V gives a non-limiting list of the water-repellant agents (the preferred products being products $H_1$ and $H_4$ of said Table).

Table VII gives a non-limiting list of auxiliary agents which may possibly be used according to the invention.

Furthermore, it is known that a certain number of plastics materials present optimal properties only insofar as these materials are plasticized. It is therefore possible to introduce, further, in the products according to the invention from 10 to 100% by weight, with respect to the weight of the thermoplastics material (more particularly in the case of PVC), of plastcizer.

In practice, it is known that the plasticizing of the thermoplastics materials may be effected either by internal plasticizing or by external plasticizing.

Internal plasticizing is effected in the course of manufacture of the thermoplastics material by copolymerisation of "soft" and "hard" polymers.

External plasticizing is effected by incorporating in the thermoplastics material an agent having a good solvent and swelling power with respect to said thermoplastics material used.

According to the present invention, plasticizing may be effected by one or the other method described hereinabove. External plasticizers which may be used, particularly in the case of PVC, are adipic esters (dibutyl adipate, benzyloctyl adipate), phosphoric esters (tricresyl, triphenyl, diphenylsylenile, trichloroethyl), diphenyloctyl, trioctyl phosphates), phthalic esters (dimethyl, diethyl, dibutyl, dinonyl, benzylbutyl, dicyclohexyl phthalates), sulfonic esters, chlorinated paraffins. With PVC powder, di-(2-ethylhexyl)-phthalate (abbreviated to DOP) will preferably be used.

The present invention also relates to a process for preparing sheets as described hereinabove.

The process according to the invention for preparing by paper-making techniques a thermoplastics sheet reinforced with cellulosic fibres, in which a thermoplastics powder and cellulosic fibres are used, is characterized in that:

(1) an aqueous suspension is prepared from a basic mixture (chosen from the group constituted by (i) the fibres and the thermoplastics substance in powder form when there is no non-binding mineral filler and (ii) the fibres, the thermoplastics substance in powder form and the non-binding mineral filler when the latter is present), an organic binding agent and a flocculating agent, then a sheet is formed, by means of the suspension thus obtained, by the wet process, which is pressed and dried; and (2) if necessary, the thermoplastics sheet thus obtained is subjected to at least one complementary treatment.

The process according to the invention is carried out in step (1) from four essential means, namely the cellulosic fibres, the thermoplastics substance in powder form, the organic binding agent and the flocculating agent. Other means may be used in step (1), namely a non-binding mineral filler, a plasticizing agent, an antistatic agent, an antioxidant agent, a core-forming agent (which particularly acts as expansion agent, especially for PVC), a dispersing agent (for the thermoplastics substance), an emulsifying agent (to emulsify the plasticizing agent) and one or more adjuvants conventional in paper-making, such as water-repellants, anti-foam and/or foam-breaking agents, dyes, optical blueing agents, retention agents, lubricating agents.

To carry out step (1), it is important not to introduce into the aqueous suspension of the basic mixture (abbreviated hereinafter to BM) all the flocculating agent before the organic binding agent. It is rathermore recommended, in order to reduce the losses under wire, either to introduce the flocculating agent after the binding agent, or, preferably, to introduce part of the flocculating agent before the binding agent is added, then the rest after the binding agent.

Of course, the relative quantities of the various constituents (fibres, thermoplastics material in powder form, possibly non-binding filler, flocculating agent, binding agent, new flocculating agent and other additives) must be in accordance with what is mentioned hereinabove.

According to a specific characteristic of step (1), 0.02 to 10 parts by weight of flocculating agent are introduced for 100 parts by weight of BM. The following will preferably be introduced into the aqueous suspension comprising 100 parts by weight of BM:

(i) 0.01 to 4 parts (advantageously 0.01 to 3 parts) by weight of flocculating agent, (ii) the organic binding agent (iii) 0.01 to 6 parts (advantageously 0.01 to 5 parts) by weight of flocculating agent.

The thermoplastics polymer may be used either in the form of a dry powder or in the form of a dispersion in water; in the latter case, the dispersion may comprise a small proportion, for example from 0.1 to 1%, of a dispersing agent.

For incorporating plasticizer in the thermoplastics sheet (particularly by a surface treatment), it is advantageous to emulsify the plasticizer by means of a conventional emulsifier in the textile or paper-making industry. For example, the derivatives of ethylpolyglycol ether will be chosen, which are particularly advantageous for obtaining homogeneous and stable aqueous emulsion. The dose of emulsifying agent will be of the order of 0.05 to 2% by weight with respect to the weight of the plasticizer. Emulsifying is obtained by adding the plasticizer in water containing the emulsifying agent and by mixing with an apparatus of the mixer type rotating at more than 250 r.p.m. This mixture with variable concentration of dioctylphthalate in water will contain for example from 100 to 990 g of dioctylphthalate for 1000 g of mixture. This technique is particularly advantageous when the plasticizer is added at step 1 of the process.

However, the most advantageous process for incorporating the plasticizer is by effecting this incorporation at step 2 of the process using the so-called size-press technique as mentioned hereinafter.

If necessary, an antioxidant agent may be introduced at step (1) to avoid ageing of the thermoplastics substance coming in the thermoplastics sheet according to the invention, in particular to prevent superficial cracks in the polystyrene, the yellowing and reduction of the mechanical properties of the PVC, under the action of the UV rays. Among suitable anti-oxidant agents, 2-(2-hydroxy-5-methylphenyl)-2H-benzotriazol may be used, preferably at the dose of 0.1 to 5% by weight with respect to the weight of the thermoplastics substance in powder form.

If necessary, an antistatic agent will be introduced either at step (1) or at step (2).

Other adjuvants, conventional in paper-making, may be used, if need be, at step (1), such as for example water-proofing agents (also called sizing agents), lubricating agents, anti-foam or foam-breaking agents, dyes, optical blueing agents. Among suitable water-proofing agents, particular mention may be made of those of Table V and, among the auxiliary agents, those mentioned in Table VII given hereinafter.

The water-proofing agent is preferably introduced at step (1) after the organic binding agent and before the 2nd fraction of flocculating agent. The quantity of water-proofing agent may be between 0.05 and 10 (advantageously between 0.05 and 5 and, preferably, between 0.1 and 3) parts by dry weight for 100 parts by weight of BM. The preferred water-proofing agents are products $H_1$ and $H_2$ of Table V hereinafter.

If necessary, at least one auxiliary agent is added at step (1) at the same time as the water-proofing agent or thereafter, said auxiliary agent being chosen particularly from the group constituted by the resistance agents in the wet state (0.1 to 5 parts by weight for 100 parts by weight of BM), anti-foam agents (0.05 to 0.2 parts by weight for 100 parts by weight of BM), dyes (in a sufficient quantity for the desired effect), fungicidal agents and, if need be, lubricating agents (0.2 to 5 parts by weight for 100 parts by weight of BM).

By carrying out step (1), a theroplastics sheet is obtained having a weight per surface unit of between 15 and 1500 g/m$^2$.

The sheet obtained at step (1) is subjected, if necessary, at step (2) to one or more complementary treatments, on paper machine or outside of paper machine in order in particular:

to improve the appearance, surface unity, to increase the superficial resistance and render the mechanical properties uniform, to reinforce the rigidity or suppleness, to obtained particular properties such as fire-proofing, non-stick, non-greasability, heat-sealability and special effects such as barrier effects and imputrescibility (resistance to bacteria and to fungi).

To this end, the means to be used are particularly the size-press, roll coater, reverse roll, presses with metal blade, with air knife, or presses with scraper. To these means are added transformation means for exploiting the thermoplasticizing on paper machine or outside of paper machine (hot air oven, gas oven, infrared, hot rolling) and for improving the surface unity: glazing, calendering and/or graining.

Step (2) may generally comprise the addition of at least one substance chosen from the group constituted by mineral fillers, organic binders, plasticizers, antioxidants, antistatic agents and adjuvants conventionally used in paper-making such as in particular sizers, dispersing agents, pigments, fluorescent agents, shading dyes, lubricating agents, viscosity modifying agents, anti-foam agents, insolubilising agents and antibiotics by means of an aqueous bath of 10 to 600 g/l. Of course, step 2 will be carried out as a function of the desired objectives.

From the practical point of view, at least one binding agent, particularly a binding agent of Table VI hereinafter and, if need be, at least one substance chosen from the non-binding mineral fillers (such as those described hereinabove in step (1), auxiliary agents (such as those given in Table VII), plasticizers and emulsifiers for plasticizers, may be used in step 2.

The quantity of dry material which may be deposited in step (2) is, in particular, between 1 and 200 g/m$^2$, taking into account the different coating means which may be used and the final properties required. By way of indication, in a non-pigmented size-press, 1 to 10 g/m$^2$ of dry matter may be applied. By pigmented couching with a Champion scraper, between 3 and 30 g/m$^2$ of dry matter may be applied on a face in one passage. On an air knife, 5 to 40 g/m$^2$ of dry matter may be applied on a face in one passage. With rigid or supple trailing blade, 5 to 40 g/m$^2$ of dry matter may be applied on a face in one passage.

The modi operandi of step 2 for adding the agents mentioned hereinabove are those described in European patent application No. 79400405.1 of June 19, 1979.

The best embodiment of the process according to the invention will be described hereinafter.

Step (1) comprises the following steps:

(a) of introducing with stirring into an aqueous suspension of fibres at 10–50 g/l (cellulosic fibres refined to an SR degree of between 15 and 65, associated, if need be, with other fibres, particularly glass and PVA fibres), the thermoplastics substance in powder form having a granulometry less than or equal to 500μ (if necessary said thermoplastics substance has been previously dispersed in water by means of a dispersing agent);

(b) of adding, if need be, a non-binding mineral filler to the suspension obtained;

(c) of diluting the flocculating agent in water from 1 to 10 times. This will preferably be a mineral flocculating agent (aluminium polychloride) which is introduced into the resultant suspension at a rate of 0.01 to 4 parts (preferably 0.01 to 3 parts) by weight for 100 parts by weight of BM;

(d) incorporating the binding agent (which may in particular be native starch previously baked at 80°–90° C., or a latex in aqueous emulsion at a concentration of 15 to 100 g/l), into the resultant suspension with stirring, either discontinuously or, preferably, continuously in the head circuits of the paper machine.

(e) incorporating either discontinuously in the mixing vat or continuously in the head circuits an antioxidant agent, an antistatic agent, a water-proofing agent, a blueing agent, one or more dyes, an anti-foam agent and possibly the lubricant.

(f) introducing the second fraction of the flocculating agent, before the headbox, at a rate of 0.01 to 6 parts (preferably 0.01 to 5 parts) by weight for 100 parts by weight of BM. The flocculating agent plays at this step an important role on the flocculation, retention and draining. These last two properties may, if need be, be improved by adding a retention agent conventional in paper-making.

(g) introducing the resultant suspension in the headbox and forming a thermoplastics sheet by pressing on a wire as described for example in the above-mentioned European patent application.

(h) after passage over the wire, proceeding with a conventional pressing, partly wet, by means of one or more multiple presses (covered or bare), with drying at a temperature of the order of 100° to 150° C., and, if need be, with the exploitation of the thermoplasticizing (for example treatment at 130°–280° C.).

The sheet obtained at step 1 which has a weight per surface unit of between 15 and 1500 g/m$^2$ is subjected, if need be, to step 2.

Step 2 comprises one or more treatments on paper machine or outside of paper machine.

The quantities of matter deposited on the fibrous sheet in the course of these surface treatments are very variable and obviously depend on the desired objectives and the manufacturing means used. In the conventional applications of printing-writing, these surface treatments may be of the type currently used on cellulosic supports. For special applications, their nature will be a function of the desired properties.

Other advantages and features of the invention will be more readily understood on reading the following non-limiting examples given by way of illustration.

EXAMPLES 1 TO 14

By proceeding as indicated hereinabove in the best embodiment, reinforced thermoplastics sheets have been prepared, having a weight per surface unit of the order of 500 g/m$^2$, the quantities and nature of the products used being given in Table VIII hereinafter, the sheets obtained in step 1 being dried at a temperature of the order of 100°–150° C., the sheets subjected to the treatment of step 2 also being dried at a temperature of the order of 100°–150° C. after said treatment.

The sheets thus obtained were then subjected to a thermoplasticizing at 180° C. for 3 minutes, then tested. The results of these tests have been shown in Table IX hereinafter; they enable the following conclusions to be drawn.

Examples 1 to 3 (prepared from PVC in powder form) show the favourable influence of the increase in the cellulosic fibre content on the physical properties, and in particular stiffness.

The presence of a plasticizer has a beneficial effect as far as suppleness is concerned.

The association of glass fibres with the cellulosic fibres (Examples 6–7 and 11) improves the dimensional stability in the wet state.

The surface treatment of step (2) is generally beneficial regarding the resistance to bending. More precisely, the sheets of Examples 7 and 11–14 do not present any crack after repeated bendings; they may be used as base support for making broad width (4 m) ground covering.

All the sheets obtained have a good aptitude for heat-shaping: it is therefore particularly advantageous to use them for heat-shaping recipients adapted to contain foodstuffs such as in particular dairy products (yoghurt, butter, fresh cheese, etc . . . ) and mayonnaise.

Finally, these sheets may be cut up then granulated to produce by extrusion, injection, plastic products reinforced with cellulosic fibres.

EXAMPLES 15 AND 16

By treatment in step 2 of the sheets of Examples 8 and 9 on a face by means of a conventional pigmented layer to improve the surface appearance, sheets are obtained having good properties of printability.

TABLE I

| Reference | Fibres which may be used<br>Type of fibre |
|---|---|
| F1 | bleached softwood kraft pulp |
| F2 | semi-bleached softwood kraft pulp |
| F3 | unbleached softwood kraft pulp |
| F4 | bleached softwood bisulfite pulp |
| F5 | unbleached softwood bisulfite pulp |
| F6 | bleached hardwood kraft pulp |
| F7 | semi-bleached hardwood kraft pulp |
| F8 | unbleached mechanical pulp |
| F9 | bleached mechanical pulp |
| F10 | Blend F1–F6 (80:20) by weight |
| F11 | Polyethlene fibres (preferably 0.8 to 1 mm long |
| F12 | Glass fibres (preferably 5 to 15μ in diameter and 3 to 6 mm long) |
| F13 | Fibres of calcium sulfate or acicular gypsum (preferably 0.5 to 3 mm long) |
| F14 | Rayon fibres |
| F15 | Recovered fibres |
| F16 | Blend F1–F13 (50:50) by weight |
| F17 | Blend F1–F11 (75:25) by weight |
| F18 | Blend F1–F12 (14:2) by weight |
| F19 | Chemical pulp of bleached straw |
| F20 | Chemical pulp of bleached alfa |
| F21 | Blend F1–F11 (16:9) by weight |
| F22 | Blend F1–F12 (18 2) by weight |
| F23 | Blend F1–F11–F12 (16:9 2) by weight |
| F24 | Polypropylene fibres (preferably 0.8 to 1 mm long) |
| F25 | Blend F1–F12 (19:5) weight |
| F26 | Rock wool (from 0.1 to 0.3 mm long) |
| F27 | Blend F1–F11–F26 (16:8:3) by weight |
| F28 | Polyvinyl alcohol fibres |

TABLE II

| References | Binding agents which may be used<br>Type of binding agent |
|---|---|
| L1 | Native starch |
| L2 | Native starch, particularly native maize starch |
| L3 | Phosphoric ester of starch (type Retamyl AP or Retabond AP) |
| L4 | Carboxymethylated starch |
| L5 | Oxidised starch |
| L6 | Enzymed starch (enzyme: α-amylase to obtain a distribution of the glucose units variable between 50 and 3000) (for the linear polymer amylose) |
| L7 | Hydroxymethylated starch |
| L8 | Technical carboxymethylcellulose (5 to 30% of sodium chloride - degree of substitution: 0.7–0.8) |
| L9 | Polymer containing 87 to 90 parts by weight of ethyl acrylate unit, 1 to 8 parts by weight of acrylonitrile units, 1 to 6 parts by weight of N—methylolacrylamide unit and 1 to 6 parts by weight of acrylic acid unit. Aqueous dispersion at 40–55% |
| L10 | Polymer containing 60 to 75 parts by weight of ethyl acrylate unit, 5 to 15 parts by weight of acrylonitrile unit, 10 to 20 parts by weight of butyl acrylate unit, 1 to 6 parts by weight of N—methylol-acrylamide unit. Aqueous dispersion at 40–55% |
| L11 | Polymer containing 60 to 65 parts by weight of butadiene unit, 35 to 40 parts by weight of acrylonitrile unit and 1 to 7 parts by weight of methacrylic acid unit. Aqueous dispersion at 40–55% |
| L12 | Polymer containing 38 to 50 parts by weight of styrene unit, 47 to 59 parts by weight of butadiene unit and 1 to 6 parts by weight of methylacrylamide unit. Aqueous dispersion at 40–55% |
| L13 | Polymer containing 53 to 65 parts by weight of styrene unit, 32 to 44 parts by weight of butadiene unit and 1 to 6 parts by weight of methylacrylamide unit. Aqueous dispersion at 40–55% |

TABLE III

| References | Flocculating agents<br>Type of flocculating agents |
|---|---|
| P1 | Alumininum sulfate |
| P2 | Alumininum polychloride (aluminium hydroxychloride |
| P3 | sodium and calcium aluminate |
| P4 | Blend of polyacrylic acid and polyacrylamide in 5–30% (weight/volume) solution |
| P5 | Polyethyleneimine in 2–50% (weight/volume) solution |
| P6 | Copolymer of acrylamide and of β-methacrylyloxyethyltrimethylammonium methylsulfate |
| P7 | Polyamine-epichlorohydrine and diamine-propylmethylamine resin in 2–50% solution |
| P8 | Polyamide-epichlorohydrine resin made from epichlorohydrine, adipic acid, caprolactame, diethylenetriamine and/or ethylenediamine, in 2–50% solution |
| P9 | Polyamide-polyamine-epichlorohydrine resin made from epichlorohydrine, dimethyl ester, adipic acid and diethylenetriamine, in 2–50% solution |
| P10 | Polyamide-epichlorohydrine resin made from epichlorohydrine, diethylenetriamine, adipic acid and ethyleneimine. |
| P11 | Polyamide-epichlorohydrine made from adipic acid, diethylenetriamine and a blend of epichlorohydrine and dimethylamine in 2–50% solution |
| P12 | Cationic polyamide-polyamine resin made from triethylenetriamine |
| P13 | Condensation products of aromatic sulfonic acids with formaldehyde |
| P14 | Aluminium acetate |
| P15 | Aluminium formate |
| P16 | Blend of acetate, sulfate and formate of aluminium |
| P17 | Aluminium chloride ($AlCl_3$) |
| P18 | Cationic starch |

NB The solutions are aqueous solutions.

TABLE IV

| References | Mineral fillers which may be used<br>Type of filler |
|---|---|
| C1 | Talc: Complex magnesium silicate - Particles of 1 to 50μ preferably 2 to 50μ - Specific weight 2.7 to 2.8 |
| C2 | Kaolin Complex silicate of aluminium hydrate - particles from 1 to 50μ, preferably 2 to 50μ - specific weight 2.58 |
| C3 | Natural calcium carbonate particles of 1.5 to 20μ, preferably 2 to 20μ - specific weight 2.7 |
| C4 | Precipitated calcium carbonate: particles of 1.5 to 20μ, preferably 2 to 20 μ - Specific weight 2.7 |
| C5 | Natural barium sulfate: particles 2 to 50μ - specific weight about 4.4–4.5 |
| C5 | Precipitated barium sulfate particles 2 to 20μ - specific weight about 4.35 |
| C6 | Silica of diatoms particles of 2 to 50μ - specific weight about 2 to 2.3 |
| C7 | Precipitated barium sulfate: hydrated calcium sulfoaluminate |

TABLE IV-continued

| References | Mineral fillers which may be used<br>Type of filler |
|---|---|
| C8 | Natural calcium sulfate particles of 2 to 50μ - specific weight about 2.32 to 2.96 |
| C9 | Hydrated alumina particles of 2 to 50μ |
| C10 | Sodium and calcium aluminate particles of 1 to 20μ - specific weight 2.2 |
| C11 | Sodium silicoaluminate particles of 1 to 20μ - specific weight about 2.12 |
| C12 | Rutile titanium: particles 0.5 to 10μ - specific weight about 4.2 |
| C13 | Anatase titanium particles of 0.5 to 10μ - specific weight about 3.9 |
| C14 | Blend C1-C6 (70:30) by weight |
| C15 | Blend C1-C3 (50:50) by weight |
| C17 | Blend C1-C12 (95:5) by weight |
| C18 | Magnesium hydroxide particles of 2 to 50μ |

NB The specific weight is expressed in g/ml.

TABLE V

| References | Water-proofing agents which may be used<br>Types of water-proofing agents |
|---|---|
| H1 | Dimer alkylketene in 5-12% (weight/volume) solution |
| H2 | Paraffin-wax emulsion at 45-55% (weight/volume) |
| H3 | Colophony |
| H4 | Modified colophony (with or without paraffin) in 20-50% (weight/volume) aqueous emulsion |
| H5 | Anhydride of dicarboxylic acids in 20-60% (weight/volume) solution or dispersion |
| H6 | Mixture of ammonium salt of a copolymer of styrene and maleic anhydride (50/50) and a copolymer of acrylonitrile and acrylic acid, in solution or dispersion 20-60% (weight/volume) |
| H7 | Ammonium salts of a copolymer of diisobutylene maleic anhydride and maleic acid, in 20-60% (weight/volume) solution or dispersion |
| H8 | Ammonium salts of a copolymer of styrene, acrylic acid, and maleic acid, in 20-60% (weight/volume) solution or dispersion |

NB The suspensions and dispersions are here aqueous suspensions and dispersions.

TABLE VI

| References | Binding agents which may be used in the surface treatment (of step 2)<br>Types of binding agent |
|---|---|
| L1 to L13 | Binding agents recommended in Table II for the mass |
| L14 | Polyvinyl alcohol |
| L15 | Casein |
| L16 | Carboxymethylcellulose |
| L17 | Gelatine |
| L18 | Methylethylcellulose |
| L19 | Carboxylated styrene-butadiene latex - 40-55% aqueous dispersion |
| L20 | Alginate |
| L21 | Dextrines |
| L22 | Copolymer based on vinylidene chloride - aqueous dispersion at 40-55% |
| L23 | Ethylene-vinyl acetate copolymer |

TABLE VII

| References | Auxiliary products which may be used<br>Types of auxiliary products |
|---|---|
| A1 | Sodium polyphosphate |
| A2 | Sodium methacrylate |
| A3 | Melamine-formaldehyde |
| A4 | Urea-formaldehyde |
| A5 | Glyoxal, in 30-70% (weight/volume) aqueous solution |
| A6 | Basic, acid, direct pigmentary shading dyes |
| A7 | Optical blueing agent |
| A8 | Calcium stearate in 30-50% (weight/volume) aqueous solution |
| A9 | Ammonium stearate in 30-50% (weight/volume) aqueous solution |
| A10 | Antifoam agent |
| A11 | Lubricating agent derived from fatty acid |

TABLE VIII

| | Example 1 | Example 2 | Example 3 | Example 4 |
|---|---|---|---|---|
| Step 1 | | | | |
| (1) Fibres | F1 = 8 | F1 = 14 | F1 = 22 | F1 = 20 |
| (2) Thermo-plastic powder | T1 = 64 | T1 = 58 | T1 = 50 | T1 = 80 |
| (3) Organic dispersant | 0.3% | 0.3% | 0.3% | 0.3% |
| (4) Mineral filler | C1 = 28 | C1 = 28 | C1 = 28 | — |
| (5) Plasticizer | 30% | 30% | 30% | — |
| (6) Emulsifier | — | — | — | — |
| (7) Flocculating agent | P7 = 2 | P7 = 2 | P7 = 2 | P2 = 0.5<br>P7 = 1.5 |
| (8) Binding agent | L1 = 2<br>L9 = 8 | L1 = 2<br>L9 = 8 | L1 = 2<br>L9 = 8 | L9 = 10 |
| (9) Water-proofing agent | H1 = 0.1 | H1 = 0.1 | H1 = 0.1 | — |
| (10) Antioxidant | 0.3% | 0.3% | 0.3% | 0.3% |
| (11) Antistatic | 1% | 1% | 1% | — |
| (12) Auxiliary | A10 = 0.1 | A10 = 0.1 | A10 = 0.1 | A10 = 0.1 |
| (13) Flocculating agent | P1 = 0.1<br>P2 = 0.5 | P1 = 0.5<br>P2 = 0.5 | P1 = 0.5<br>P2 = 0.5 | P1 = 0.5<br>P2 = 0.5<br>P5 = 0.15 |
| (14) Lubricant | — | — | — | 2 |
| Step 2 | | | | |
| (15) Treatment | — | — | — | — |
| Take-up (in g/m²) | — | — | — | |
| | Example 5 | Example 6 | Example 7 | Example 8 |

TABLE VIII-continued

| | | | | |
|---|---|---|---|---|
| Step 1 | | | | |
| (1) Fibres | F1 = 30 | F18 = 6 | F22 = 20 | F1 = 30 |
| (2) Thermo-plastics powder | T1 = 70 | T1 = 56 | T1 = 80 | T3 = 70 |
| (3) Organic dis-persant | 0.3% | 0.3% | 0.3% | 0.3% |
| (4) Mineral filler | — | C1 = 28 | — | — |
| (5) Plasticizer | — | 30% | — | — |
| (6) Emulsifier | — | 2% | — | — |
| (7) Flocculating agent | P2 = 0.5<br>P7 = 1.5 | P7 = 2 | P2 = 2 | P2 = 0.5<br>P7 = 1.5 |
| (8) Binding agent | L9 = 10 | L1 = 2<br>L9 = 8 | L1 = 2<br>L9 = 8 | L9 = 10 |
| (9) Water-proofing agent | — | H1 = 0.1 | H = 0.1 | — |
| (10) Antioxidant | 0.3% | 0.3% | — | — |
| (11) Antistatic | — | — | — | — |
| (12) Auxiliary | A10 = 0.1 | A10 = 0.1 | A10 = 0.1 | A10 = 0.1 |
| (13) Flocculating agent | P1 = 0.1<br>P2 = 0.5<br>P5 = 0.15 | P1 = 0.5<br>P2 = 0.5 | P1 = 0.5<br>P2 = 0.5 | P2 = 1<br>P7 = 0.15 |
| (14) Lubricant | 2 | — | — | — |
| Step 2 | | | | |
| (15) Treatment | — | — | Size-press | — |
| Take-up (in g/m$^2$) | — | — | 100 | — |

| | Example 9 | Example 10 | Example 11 | Example 12 | Example 13 | Example 14 |
|---|---|---|---|---|---|---|
| Step 1 | | | | | | |
| (1) | F1 = 30 | F1 = 14 | F22 = 20 | F1 = 10 | F1 = 30 | F1 = 30 |
| (2) | T2 = 70 | T2 = 58 | T1 = 80 | T1 = 90 | T3 = 70 | T2 = 70 |
| (3) | 0.3% | 0.3% | 0.3% | 0.3% | 0.3% | 0.3% |
| (4) | — | C1 = 28 | — | — | — | — |
| (5) | — | — | — | — | — | — |
| (6) | — | — | — | — | — | — |
| (7) | P2 = 0.5<br>P7 = 1.5 | P2 = 0.5<br>P7 = 1.5 | P7 = 2<br>L1 = 2 | P7 = 2<br>L1 = 2 | P2 = 0.5<br>P7 = 1.5 | P2 = 0.5<br>P7 = 1.5 |
| (8) | L9 = 10 | L9 = 10 | L9 = 8 | L9 = 8 | L9 = 10 | L9 = 10 |
| (9) | — | H1 = 0.1 | H1 = 0.1 | H1 = 0.1 | — | H1 = 0.1 |
| (10) | — | 0.3% | — | — | — | 0.3% |
| (11) | — | — | — | — | — | — |
| (12) | A10 = 0.1 | A10 = 0.1 | A10 = 0.1 | A10 = 0.1 | A10 = 0.1 | A10 = 0.1 |
| (13) | P2 = 1<br>P5 = 0.15 | P1 = 0.5<br>P2 = 0.5 | P1<br>P2 | P1<br>P2 | P2 = 1 | P2 = 1 |
| | P5 = 0.15 | P2 = 0.5<br>P5 = 0.15 | P2<br>P5 | P2<br>P5 | P5 = 0.15 | P5 = 0.15 |
| (14) | — | 1 | 1 | 1 | — | — |
| Step 2 | | | | | | |
| (15) | — | — | Size-press | Size-press | Size-press | Size-press |
| Take-up (g/m$^2$) | — | — | 50 | 50 | 100 | 100 |

TABLE VIII-continued

NOTES
(1) The quantities of fibres are expressed in parts by weight
(2) The quantities of thermoplastics substance in powder form are expressed in parts by weight the granulometry is less than 500μ; T1 = PVC, T2 = polyethylene and T3 = polystyrene
(3) The quantities of organic dispersing agent are expressed in % by weight with respect to the weight of the thermoplastics substance in powder form.
(4) The quantities of non-binding mineral filler are expressed in parts by weight for 100 parts by weight of BM.
(5) The plasticizer is here bis(2-ethylhexyl)-phthalate (abbreviated to DOP); the quantities are expressed in % by weight with respect to the weight of the thermoplastics substance in powder form.
(6) The emulsifier of the plasticizer is here an arylpolyglycol ether; the quantities are expressed in % with respect to the weight of the plasticizer.
(7) The quantities of flocculating agent introduced before the binding agent are expressed in parts by weight for 100 parts by weight of BM.
(8) The quantities of binding agent are expressed in parts by weight for 100 parts by weight of BM.
(9) The quantities of water-proofing agent are expressed in parts by weight for 100 parts by weight of BM.
(10) The antioxidant is here 2-(2-hydroxy-5-methyl-phenyl-2H—benzotriazol; the quantities are expressed in % by weight with respect to the weight of the thermoplastics substance in powder form.
(11) The antistatic agent is here a derivative of quaternary ammonium; the quantities are expressed in % by weight with respect to the weight of the thermoplastics substance in powder form.
(12) The quantities of auxiliary agent are expressed in parts by weight for 100 parts by weight of BM.
(13) The quantities of floculating agent introduced after the binding agent are expressed in parts by weight for 100 parts by weight of BM.
(14) The quantities of lubricant (derivative of fatty acid) are expressed in parts by weight for 100 parts by weight of BM.
(15) The treatment in step 2 when it is effected concerns the addition by size-press of a plasticizer (990 g/l aqueous emulsion of DOP containing 2% by weight of arylpolyglycol ether with respect to the weight of the DOP).

TABLE IX

| | Properties after thermoplasticizing at 180° C. for 3 minutes | | | | | | | | | | | |
|---|---|---|---|---|---|---|---|---|---|---|---|---|
| | Example 1 | Example 2 | Example 3 | Example 4 | Example 5 | Example 6 | Example 7 | Example 8 | Example 9 | Example 10 | Example 11 | Example 12 |
| Weight per surface unit ($g/m^2$) | 510 | 520 | 498 | 504 | 495 | 505 | 510 | 508 | 485 | 498 | 515 | 516 |
| Thickness (μ) | 611 | 599 | 620 | 606 | 598 | 609 | 598 | 620 | 588 | 597 | 622 | 619 |
| Bulk | 1.19 | 1.15 | 1.24 | 1.20 | 1.21 | 1.20 | 1.17 | 1.22 | 1.21 | 1.19 | 1.20 | 1.20 |
| Density | 0.83 | 0.87 | 0.80 | 0.83 | 0.82 | 0.82 | 0.85 | 0.81 | 0.82 | 0.83 | 0.82 | 0.83 |
| Tensile strength (kg) | 8.2 | 10.8 | 19.3 | 13.5 | 16.5 | 7.5 | 9.5 | 8.5 | 9.3 | 7.9 | 10.2 | 8.5 |
| Elongation at rupture | 2.9% | 4.6% | 5.2% | 3.2% | 4.8% | 2.5% | 3% | 1.9% | 2.6% | 3.5% | 2.7% | 3.2% |
| Internal cohesion in the dry state (a) | 350 | 450 | 480 | 360 | 450 | 265 | 320 | 260 | 365 | 285 | 310 | 280 |
| Internal cohesion in the wet state (a) | 240 | 295 | 350 | 195 | 280 | 200 | 265 | 180 | 225 | 200 | 245 | 175 |
| Dimensional stability (b) | — | 0.3% | 0.4% | 0.1% | 0.3% | — | — | 0.3% | 0.4% | 0.6% | — | — |
| Stiffness (Taber) | 52 | 80 | 120 | 145 | 155 | 65 | 45 | 195 | 135 | 60 | 69 | 45 |
| Aptitude for thermoshaping at a temperature higher than 150° C. | very good | very good | very good | good | good | very good | good | good | good | good | very good | very good |

Notes
(a) measured on Scott-Bond apparatus
(b) measured after immersion for 24 hrs. in water.

What is claimed is:

1. A sheet adapted to be subjected to heat treatment sufficient to cause melting of the thermoplastic material contained therein comprising:

a basic mixture consisting essentially of 5 to 30% by weight of cellulosic fibers refined to a Shopper-Riegler degree of between 15 and 65 with 0 to 30 parts by weight of the cellulosic fibers being replaced with non-cellulosic fibers, and 95 to 70% by weight of a powder of thermoplastic material; said mixture having from 0.02 to 10 parts by weight for 100 parts by weight of said basic mixture, of at least one flocculating agent consisting of a water soluble multivalent salt or a water soluble organic polymer having flocculating activity; and from 2.0 to 30 parts by weight, for 100 parts by weight of said basic mixtures, of at least one binding agent selected from polymer latexes and starches.

2. The sheet of claim 1 wherein said non-cellulosic fibers are glass fibers.

3. The sheet of claim 1 wherein thermoplastic material is polyvinylchloride.

4. A high thermoplastic content sheet capable of being formed in a papermaking process and adapted to be subjected to heat treatment sufficient to cause melting of the thermoplastic material contained therein comprising:

a basic mixture consisting of 5 to 30% by weight of cellulosic fibers refined to a Shopper-Riegler degree of between 15 and 65 with 0–30 parts by weight of the cellulosic fibers being replaced with non-cellulosic fibers, and 95 to 70% by weight of a powder of thermoplastic material; said mixture having from 0.02 to 10 parts by weight for 100 parts by weight of said basic mixture, of at least one flocculating agent by direct addition; and 2 to 30 parts by weight, for 100 parts by weight of said basic mixture, of at least on binding agent taken from the group consisting of latexes and starch, said starch comprising in its linear polymer constituent 50–6000 anydroglucose units per molecule, said flocculating agent consisting of water soluble multivalent salt or water soluble organic polymers having flocculating activity and being added to the basic material part prior to the addition of the binder and part after the binder has been added, thereby permitting formation of a high thermoplastic content sheet by papermaking methods.

5. A process for the preparation of a sheet adapted to be subjected to heat treatment sufficient to cause melting of thermoplastic material contained therein comprising the steps of:

preparing an aqueous suspension of a basic mixture consisting essentially of 5 to 30% by weight of cellulosic fibers with 0 to 30 parts by weight of the cellulosic fibers being replaced with non-cellulosic fibers and 95 to 70% by weight of a thermoplastic material in fine powder form;

successively adding from 0.01 to 4 parts by weight, for 100 parts by weight of said basic mixture, of a flocculating agent, then 2 to 30 parts by weight, for 100 parts by weight of said basic mixture, of a binding agent selected from polymer latexes or starches, then 0.01 to 6 parts by weight for 100 parts by weight of said basic mixture, of a flocculating agent consisting of a water soluble multivalent salt or a water soluble organic polymer having flocculating activity; and shaping, from the suspension obtained, a sheet by the wet process, which is pressed and dried.

6. The process of claim 5 wherein an adjuvant is added and is selected from the group consisting of a water-proofing agent, a lubricating agent, and anti-foam or foam-breaking agent, an optical blueing agent and an antioxident.

7. The process of claim 5 wherein the flocculating agent are water soluble salts of: alumuninum, iron(II), iron(III), zinc or chromium.

8. The process of claim 5 wherein the flocculating agent are halides, sulfates or phosphates.

* * * * *